US008888150B2

(12) United States Patent
Nagaoka

(10) Patent No.: US 8,888,150 B2
(45) Date of Patent: Nov. 18, 2014

(54) LATCH DEVICE FOR VEHICLE

(71) Applicant: Mitsui Kinzoku Act Corporation, Yokohama (JP)

(72) Inventor: Tomoharu Nagaoka, Yokohama (JP)

(73) Assignee: Mitsui Kinzoku Act Corporation, Yokohama-shi (JP)

( * ) Notice: Subject to any disclaimer, the term of this patent is extended or adjusted under 35 U.S.C. 154(b) by 0 days.

(21) Appl. No.: 13/788,712

(22) Filed: Mar. 7, 2013

(65) Prior Publication Data

US 2013/0270845 A1 Oct. 17, 2013

(30) Foreign Application Priority Data

Apr. 11, 2012 (JP) ..... 2012-090442

(51) Int. Cl.
*E05B 15/02* (2006.01)

(52) U.S. Cl.
USPC . 292/341.17; 292/340; 292/341; 292/341.12; 292/DIG. 56

(58) Field of Classification Search
USPC ..... 292/341.17, 340, 341, 341.12, DIG. 56
See application file for complete search history.

(56) References Cited

U.S. PATENT DOCUMENTS

| | | | | |
|---|---|---|---|---|
| 4,856,829 | A * | 8/1989 | Nakamura et al. | 292/216 |
| 5,642,636 | A * | 7/1997 | Mitsui | 70/237 |
| 5,758,912 | A * | 6/1998 | Hamada | 292/216 |
| 6,749,234 | B2 * | 6/2004 | Bruce | 292/216 |
| 7,188,872 | B2 * | 3/2007 | Kalargeros et al. | 292/216 |
| 7,195,292 | B2 * | 3/2007 | Ketelsen et al. | 292/216 |
| 7,467,816 | B2 * | 12/2008 | Nakagawa et al. | 292/216 |
| 7,789,440 | B2 * | 9/2010 | Graute et al. | 292/216 |
| 8,342,582 | B2 * | 1/2013 | Bendel et al. | 292/216 |
| 8,631,834 | B2 * | 1/2014 | Yang | 140/123 |
| 8,727,403 | B2 * | 5/2014 | Johnson et al. | 292/340 |
| 2010/0102614 | A1 | 4/2010 | Kreuels et al. | |

FOREIGN PATENT DOCUMENTS

| | | | |
|---|---|---|---|
| EP | 0 628 682 | A1 | 12/1994 |
| JP | 2002-276228 | A | 9/2002 |
| JP | 2009-041289 | A | 2/2009 |

* cited by examiner

*Primary Examiner* — Mark Williams

(74) *Attorney, Agent, or Firm* — Foley & Lardner LLP

(57) ABSTRACT

A latch device for a vehicle includes: a latch configured to hold and engage with a striker; and a latchet configured to maintain an engagement condition between the striker and the latch by meshing with the latch. Between a meshing surface of the latch and a meshing surface of the latchet that mesh with each other, one meshing surface is formed narrower than the other meshing surface. A supporting member is arranged at a side of the latch or the latchet having the one meshing surface narrower than the other meshing surface with a gap provided between a side face of the latch or the latchet and the supporting member. A periphery of the supporting member including the end face is covered with a resin material and the gap is filled up with the resin material.

6 Claims, 12 Drawing Sheets

LATCH DEVICE FOR VEHICLE

CROSS-REFERENCE TO RELATED APPLICATIONS

The present application claims priority to and incorporates by reference the entire contents of Japanese Patent Application No. 2012-090442 filed in Japan on Apr. 11, 2012.

BACKGROUND OF THE INVENTION

1. Field of the Invention

The present invention relates to a latch device for vehicle used for a door, a rear door, a trunk lid, a seat back, a seat cushion, and the like of a vehicle.

2. Description of the Related Art

A latch device for a vehicle, which is provided in a door and the like of a vehicle and locks the door, is typically configured from a meshing mechanism that includes a metal plate-like latch capable of engaging a striker at a car body side and a metal plate-like latchet that prevents rotation of the latch by meshing with the latch. In such a meshing mechanism, an abutting sound occurs due to abutting of metals when the latch abuts on the latchet. Therefore, it is desired to reduce the abutting sound.

For example, Japanese Laid-open Patent Publication No. 2009-41289 discloses a configuration in which a resin portion is provided in a slantly-crossed-belt-shaped manner by molding a resin material in such a way as to be embedded in a band-like groove portion formed in an approximately center part of a latchet in a plate-thickness direction, and this resin portion is caused to function as a buffer, so that an abutting sound occurring when the latchet abuts on a meshing surface of a latch is reduced. Also, Japanese Laid-open Patent Publication No. 2002-276228 discloses a configuration in which a resin material is protruded from both sides of a meshing surface by covering both side parts of the latchet in a plate-thickness direction with the resin material, and this protruded portion is caused to function as a buffer, so that an abutting sound is reduced.

In the above-described configuration in Japanese Laid-open Patent Publication No. 2009-41289, it is possible to reduce the abutting sound by the resin portion that functions as the buffer when the latch meshes with the latchet. However, because this resin portion is bridged across the center part of the latchet in a slantly-crossed-belt-shaped manner, there is a possibility that the resin material gradually turns up and peels off as the meshing between the latch and the latchet is repeated, and thus, it is necessary to prevent the turning up by increasing the thickness of the buffer. Therefore, it is necessary to deeply form the groove portion of the latchet, and this leads to a problem in machining the groove portion. Also, a similar problem may be caused in the above-described configuration in Japanese Laid-open Patent Publication No. 2002-276228, and there is a possibility that the resin portion that wraps the both side parts of the latchet turns up and peels off.

The present invention has been made in view of the foregoing, and a purpose of the invention is to provide a latch device for a vehicle capable of reducing an abutting sound of a latch and a latchet for a long period of time.

SUMMARY OF THE INVENTION

It is an object of the present invention to at least partially solve the problems in the conventional technology.

A latch device for vehicle according to the present invention includes: a latch configured to hold and engage with a striker; and a latchet configured to maintain an engagement condition between the striker and the latch by meshing with the latch. Between a meshing surface of the latch and a meshing surface of the latchet that mesh with each other, one meshing surface is formed narrower than the other meshing surface. A supporting member is arranged at a side of the latch or the latchet having the one meshing surface narrower than the other meshing surface with a gap provided between a side face of the latch or the latchet and the supporting member, and an end face of the supporting member is provided at a lower position than the one meshing surface. A periphery of the supporting member including the end face is covered with a resin material and the gap is filled up with the resin material, and an exterior surface of the resin material covering the end face is provided at a higher position than the one meshing surface, so that the exterior surface is formed as a buffer capable of abutting on the other meshing surface.

With such a configuration, when the latch meshes with the latchet, the buffer formed of the resin material is provided at a side of one of meshing surfaces, and this buffer firstly abuts on the other meshing surface of the latch or the latchet, whereby an abutting sound at the time of meshing can be reduced. At this time, because the periphery of the supporting member provided at the side of the latch or the latchet having the one meshing surface is covered with the resin material and the gap is filled up with the resin material; the resin material is firmly fixed and held, and the turning up or peeling off of the resin material can be prevented even if the meshing operation between the latch and the latchet is repeated; and the abutting sound can be reduced for a long period of time. Furthermore, because the end face of the supporting member is provided inside the exterior surface of the resin material that serves as the buffer, excessive bending of the resin material (the exterior surface) at the time of meshing can be prevented, so that the peeling off of the resin material can be further securely prevented.

The one meshing surface is a meshing surface of the latchet, and the supporting member is integrally fixed to the side of the latchet, whereby the supporting member can be configured as a part of the latchet lever that causes the latchet to rotate. Therefore, it is unnecessary to provide the latchet with a separate supporting member, thus a simple structure can be realized.

The latchet and the latchet lever may be integrally covered with the resin material at least under a condition that the meshing surface of the latchet is exposed. In doing so, the resin material may come around each gap and the like formed between the latchet and the latchet lever, and therefore, the resin material can be further firmly provided, in addition to high holding effect of the resin material by the above-described supporting member and the gap. Accordingly, the occurrence of the turning up and peeling off can be further securely prevented.

The above and other objects, features, advantages and technical and industrial significance of this invention will be better understood by reading the following detailed description of presently preferred embodiments of the invention, considered in connection with the accompanying drawings.

BRIEF DESCRIPTION OF THE DRAWINGS

FIG. 5A is a perspective view in the condition that the latch is in the half-latch position and FIG. 5B is a perspective view in the condition that the latch is in the full-latch position;

FIG. 12A is a cross-sectional view in a condition that the latch does not mesh with the latchet, FIG. 12B is a cross-sectional view in a condition when the latch begins to abut on the latchet, and FIG. 12C is a cross-sectional view in a condition that the latch fully meshes with the latchet.

DETAILED DESCRIPTION OF THE PREFERRED EMBODIMENTS

Hereinafter, a latch device for a vehicle according to the present invention will be described in detail with reference to the appended drawings by taking favorable embodiments.

Figure 1:
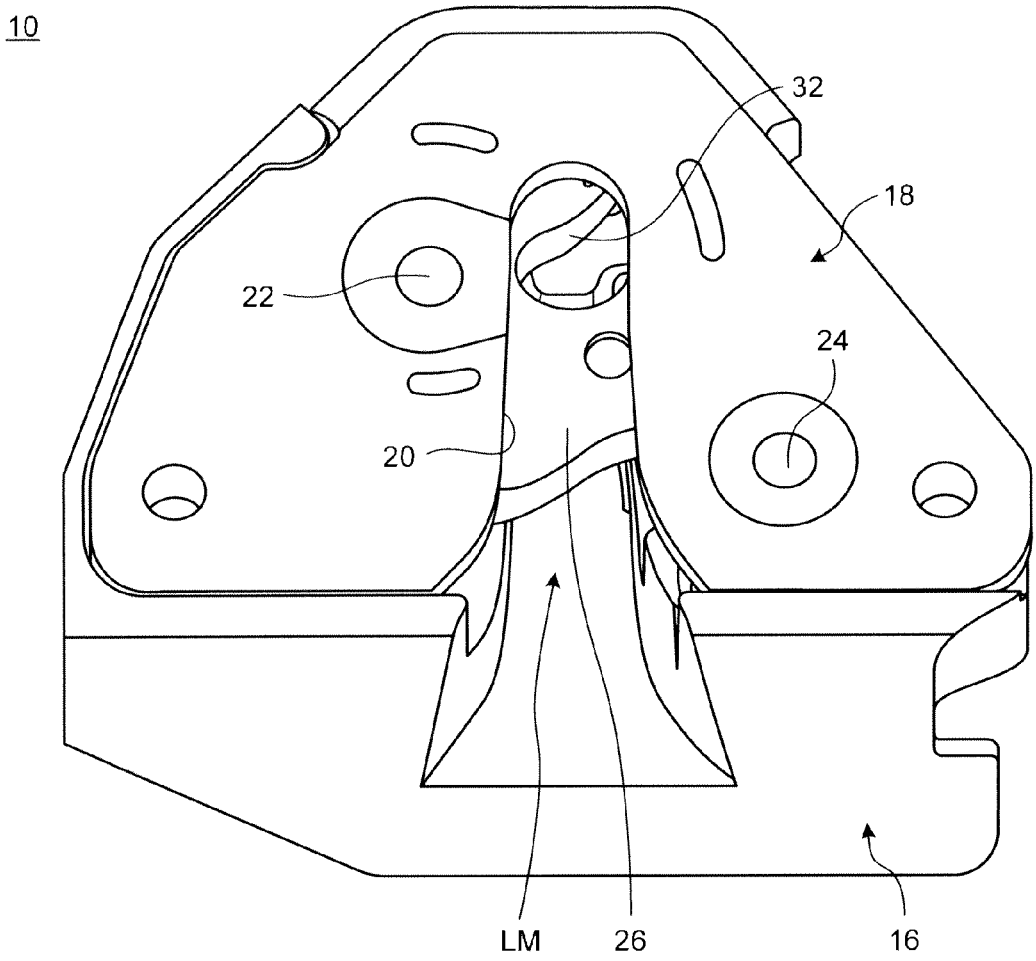
FIG. 1 is a perspective view illustrating a schematic configuration of a latch device for vehicle according to an embodiment of the present invention.
Figure 2:
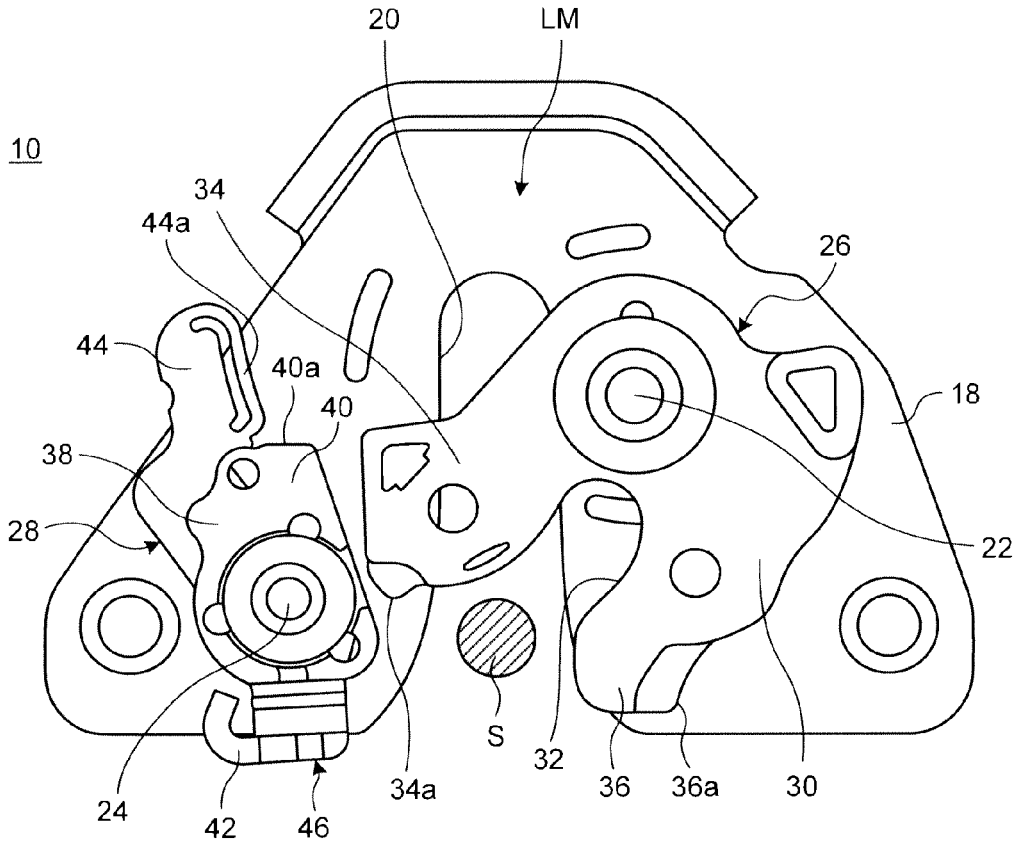
FIG. 2 is a plan view of the latch device for a vehicle in a condition that a latch is in an unlatch position.
Figure 3:
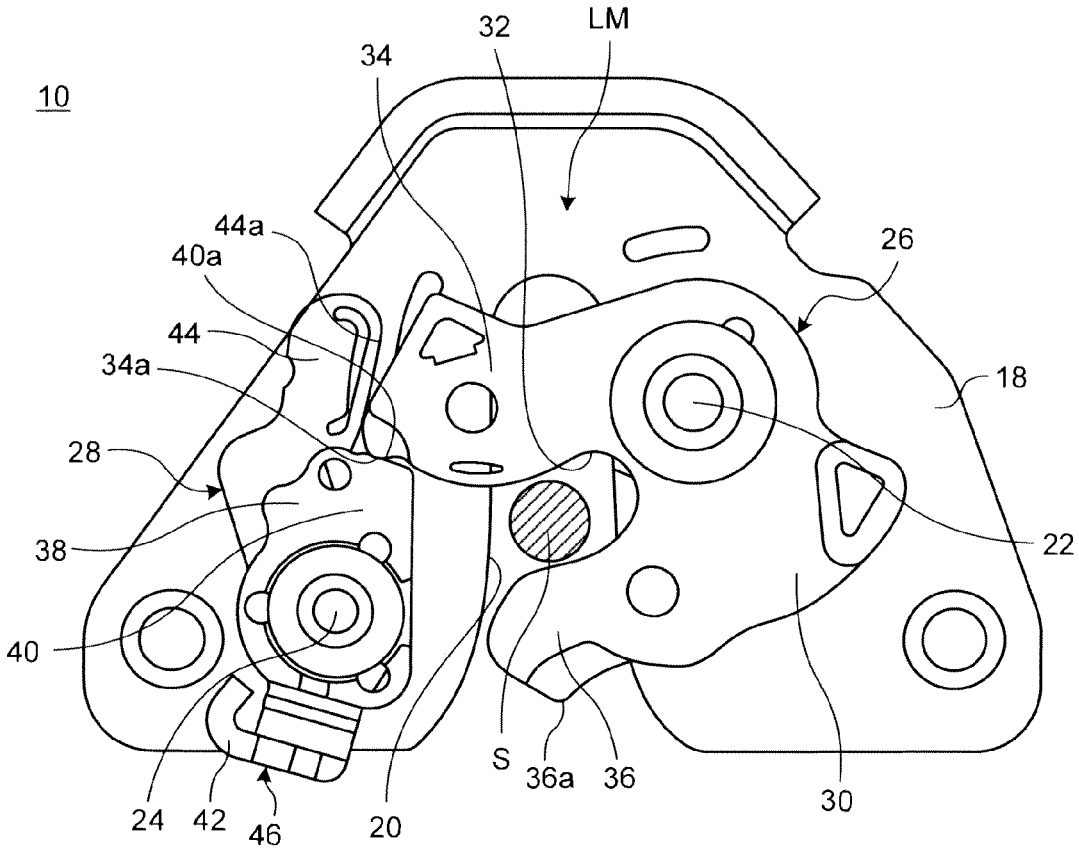
FIG. 3 is a plan view of the latch device for a vehicle in a condition that the latch is in a half-latch position.
Figure 4:
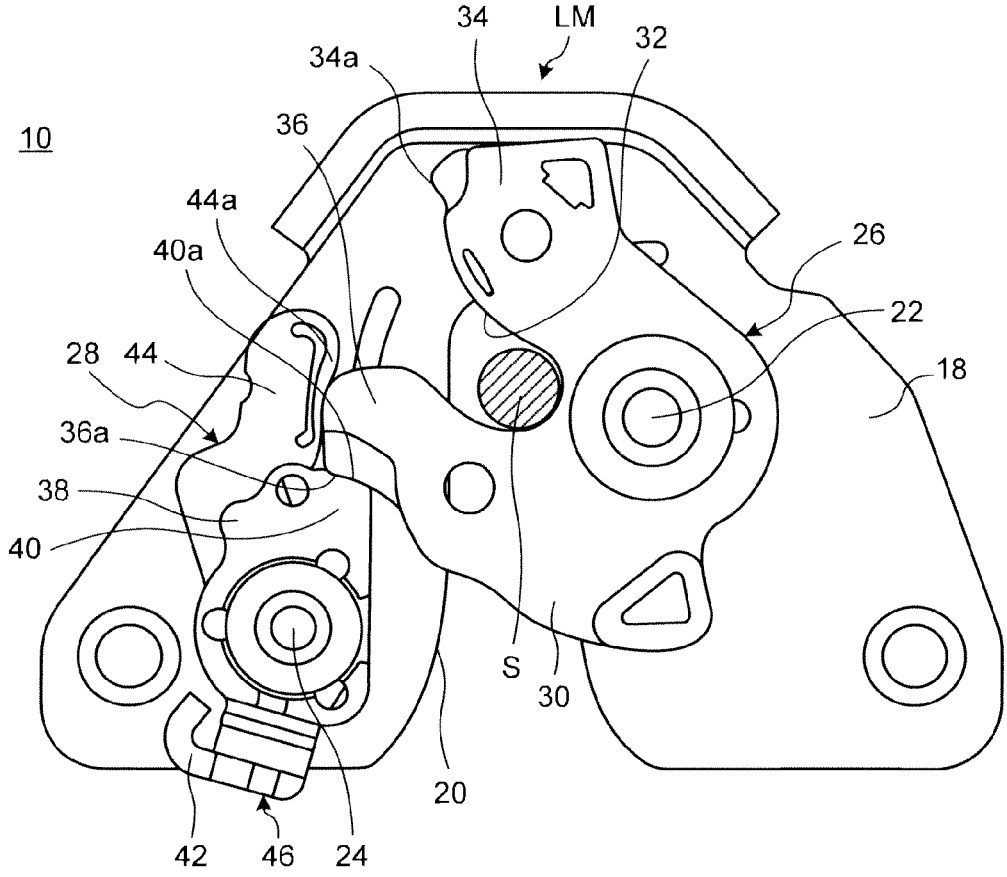
FIG. 4 is a plan view of the latch device for a vehicle in a condition that the latch is in a full-latch position.
Figure 5A:
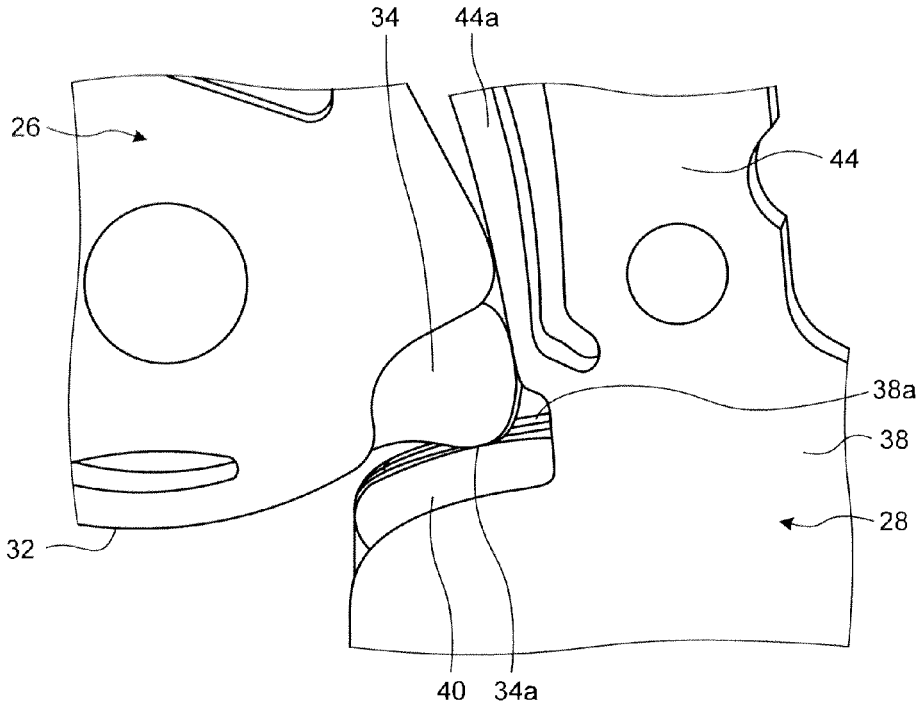
FIGS. 5A and 5B are principal part-enlarged perspective views of the latch and a latchet in a meshing condition.
Figure 5B:
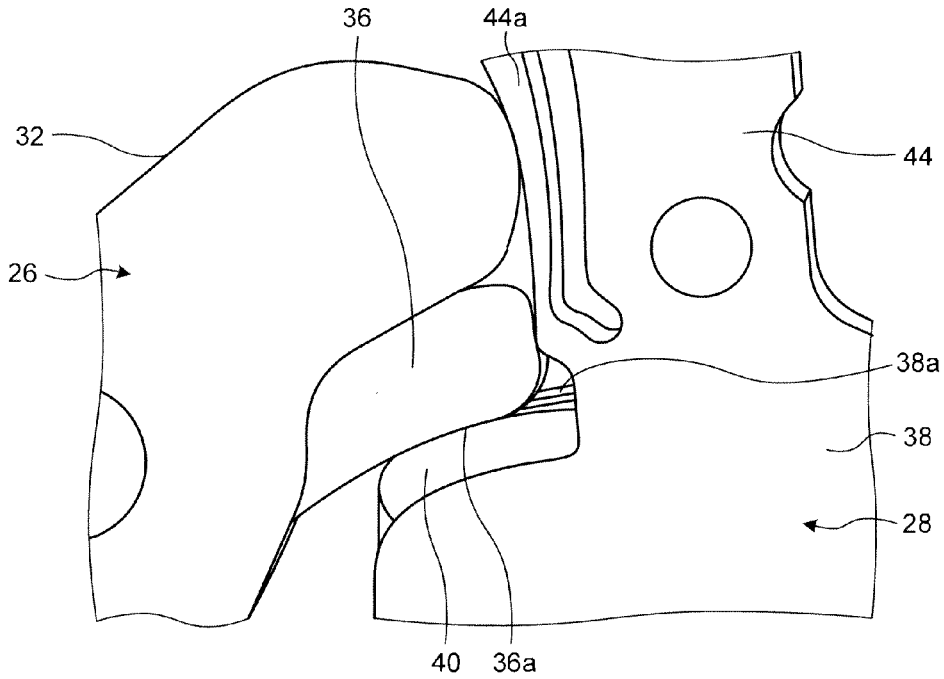

FIG. 1 is a perspective view illustrating a schematic configuration of a latch device for a vehicle 10 according to an embodiment of the present invention. FIGS. 2 to 4 are plan views illustrating an engagement condition of a striker S and a latch 26 in the latch device for the vehicle 10 illustrated in FIG. 1, and a meshing condition of the latch 26 and a latchet 28 at that time; FIG. 2 is a plan view in a condition that the latch 26 is in an unlatch position; FIG. 3 is a plan view in a condition that the latch 26 is in a half-latch position; and FIG. 4 is a plan view in a condition that the latch 26 is in a full-latch position.

As illustrated in FIGS. 1 to 4, the latch device for the vehicle 10 according to the present embodiment maintains a door in a close condition with respect to a body of a car by causing a meshing mechanism LM to engage with the striker S provided in the body of the car (car body) of a four-wheeled vehicle.

The latch device for the vehicle 10 includes a main body 16 that has an approximately triangle shape in a plan view and houses the meshing mechanism LM therein, and a cover plate 18 that serves as a cover body to block up an opening formed in one surface side of the main body 16.

A striker entry groove 20 for the striker S to enter is provided in an approximately center portion of the cover plate 18; a latch axis 22 and a latchet axis 24 are provided at both sides placing the striker entry groove 20 in between. The latch axis 22 and the latchet axis 24 rotatably support the latch 26 and the latchet 28 that constitute the meshing mechanism LM, respectively, and are fixed between the main body 16 and the cover plate 18. The striker entry groove 20 is a notch formed from a center portion of one end side of the cover plate 18 toward an inner portion, and the width is formed such that the striker S can be inserted.

As illustrated in FIGS. 2 to 4, the latch 26 is a metal plate-shaped member having a through hole formed at an approximately center thereof and to which the latch axis 22 is inserted; and the most of an exterior surface of the latch 26, except a first meshing surface 34*a* and a second meshing surface 36*a*, is covered with a molded resin cover (cover member) 30 formed of a resin material (for example, synthetic resin). The latch 26 includes an engagement groove 32 that is an inward notch, a half-latch meshing portion 34 positioned at a left side of the engagement groove 32 and serving as a striker abutting portion on which the striker S abuts, and a full-latch meshing portion 36 positioned at a right side of the engagement groove 32. The first meshing surface (half-latch side meshing surface) 34*a* is formed at a tip of the half-latch meshing portion 34, and the second meshing surface (full-latch side meshing surface) 36*a* is formed at an tip of the full-latch meshing portion 36.

The latch 26 rotates about an axis center of the latch axis 22 such that the engagement groove 32 intersects with the striker entry groove 20. The latch 26 is biased in a counterclockwise direction of FIGS. 2 to 4 centering around the latch axis 22 by a latch spring (not illustrated) arranged between the main body 16 and the latch 26.

As illustrated in FIGS. 2 to 4, the latchet 28 is a metal plate-shaped (plate piece-shaped) member having a through hole formed in an approximately center thereof and to which the latchet axis 24 is inserted, and restricting a rotation position of the latch 26; and the most part of an exterior surface of the latchet 28 except a meshing surface (latchet side meshing surface) 40*a* is covered with a molded resin cover (cover member) 38 formed of a resin material (for example, synthetic resin) (also, see FIGS. 5A to 7). The latchet 28 has a meshing portion 40 extending outward in a radial direction from an outer circumference of the through hole to which the latchet axis 24 is inserted, a release lever unit 42 provided at a lower end in FIG. 2, and a protrusion piece 44 protruding upward. Although the detail will be described later, a latchet lever 46 is integrally provided to a side part of the latchet 28 (see FIGS. 6 and 7), and the release lever unit 42 is formed in a part of the latchet lever 46.

The latchet 28 rotates about an axis center of the latchet axis 24 and is biased in a clockwise direction of FIG. 2 centering around the latchet axis 24 by a latchet spring (not illustrated) arranged between the main body 16 and the latchet 28. The meshing portion 40 restricts rotation of the latch 26 in the counterclockwise direction by meshing with the half-latch meshing portion 34 or the full-latch meshing portion 36 of the latch 26, as illustrated in FIGS. 3 and 4. The protrusion piece 44 has an elastic abutting portion 44*a*, which is a part of the resin cover 38 formed into a flat-ring shape, at a side face of a latchet 28 side, and this elastic abutting portion 44*a* functions as a stopper portion that abuts on the latch 26 at the time of meshing illustrated in FIGS. 3 and 4.

Here, an engagement operation between the meshing mechanism LM and the striker S will be described with reference to FIGS. 2 to 4.

First, as illustrated in FIG. 2, in a state where an opening of the engagement groove 32 corresponds with an opening of the striker entry groove 20 formed in the cover plate 18, and the full-latch meshing portion 36 positioned at a right side of the engagement groove 32 retracted from the striker entry groove 20, the latch 26 does not engage with the striker S. Hereinafter, a state in which the latch 26 is positioned at the position where the latch 26 does not engage with the striker S illustrated in FIG. 2 is referred to as a "unlatch position". In a state where the latch 26 is in the unlatch position, a door to which the latch device for the vehicle 10 is attached can be opened/closed without operating an operation handle and the like.

Next, when the door is closed, the latch device for the vehicle 10 approaches so as to engage with the striker S provided in a body of a car. This causes the latch 26 to rotate in the clockwise direction centering around the latch axis 22 (hereinafter, referred to as an "engagement direction") in accordance with the engagement with the striker S, and causes the full-latch meshing portion 36 to gradually move from a front end side to an inner part side of the striker entry groove 20 to traverse the striker entry groove 20, as illustrated in FIG. 3. In this case, although the latch 26 engages with the striker S shortly before a full-latch position described below, the meshing portion 40 of the latchet 28 meshes with the half-latch meshing portion 34 (also, see FIG. 5A); therefore, the rotation in the counterclockwise direction (hereinafter, referred to as a "release direction") is restricted. Hereinafter, a state where the latch 26 is positioned at the position illustrated in FIG. 3 is referred to as a "half-latch position" of the latch 26. In a state where the latch 26 is in the half-latch position, the door to which the latch device for the vehicle 10 is attached cannot be opened without switching the latch 26 to the unlatch position by operating the operation handle and the like.

Then, when the latch 26 further rotates in the clockwise direction from the half-latch position, the opening of the striker entry groove 20 is blocked up by the full-latch meshing portion 36 traversing the inner part of the striker entry groove 20 as illustrated in FIG. 4. In this state, the latch 26 fully engages with the striker S and the meshing portion 40 meshes with the full-latch meshing portion 36 (also, see FIG. 5B), thus the rotation in the release direction is restricted. Hereinafter, a state where the latch 26 is positioned at the position illustrated in FIG. 4 is referred to as a "full-latch position" of the latch 26. In a state where the latch 26 is in the full-latch position, the door to which the latch device for the vehicle 10 is attached cannot be opened without switching the latch 26 to the unlatch position by operating the operation handle and the like.

Note that the release lever unit 42 of the latchet 28 functions as an operation unit when causing the latchet 28 to rotate in a direction away from the latch 26, which is the counterclockwise direction in FIGS. 3 and 4, to release the meshing condition between the latch 26 and the latchet 28, and returning the latch 26 to in the unlatch position. In other words, the engagement condition between the meshing mechanism LM and the striker S (the meshing condition between the latch 26 and the latchet 28) illustrated in FIGS. 3 and 4 can be released by operating the release lever unit 42.

Next, a more specific configuration of the latchet 28 will be described.

Figure 6:
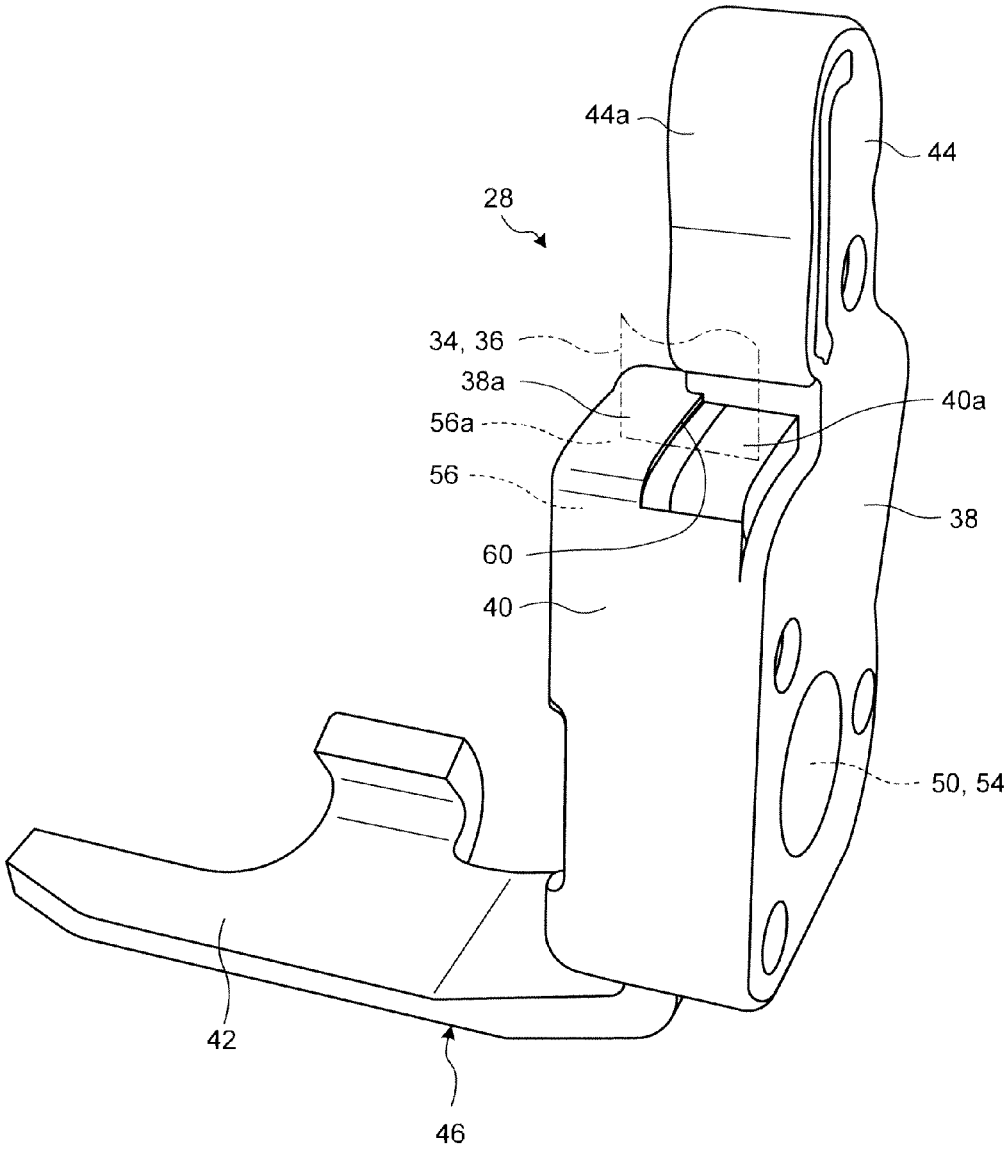
FIG. 6 is a perspective view of the latchet when seen from a main body side.
Figure 7:
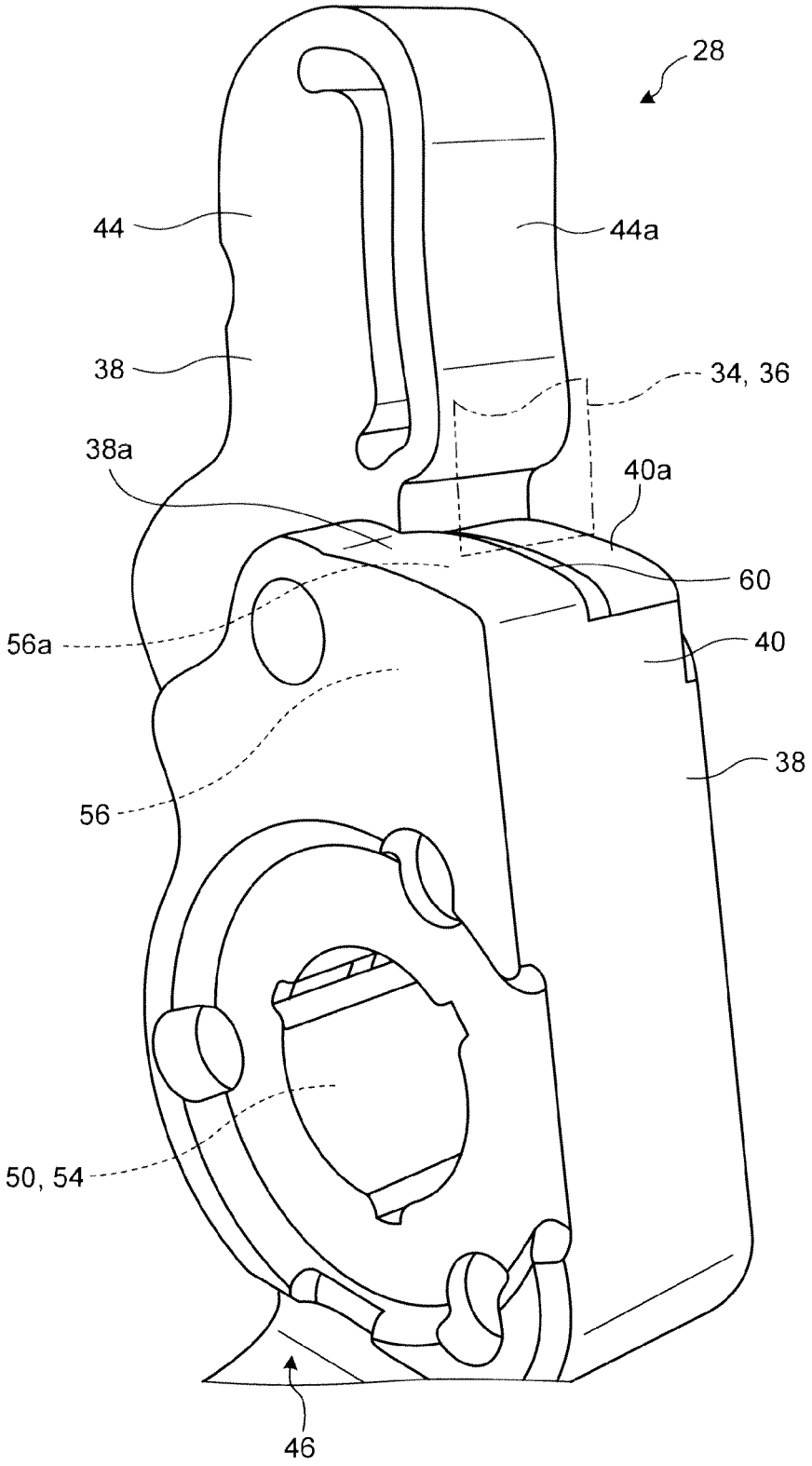
FIG. 7 is a perspective view of the latchet when seen from a cover plate side.
Figure 8:
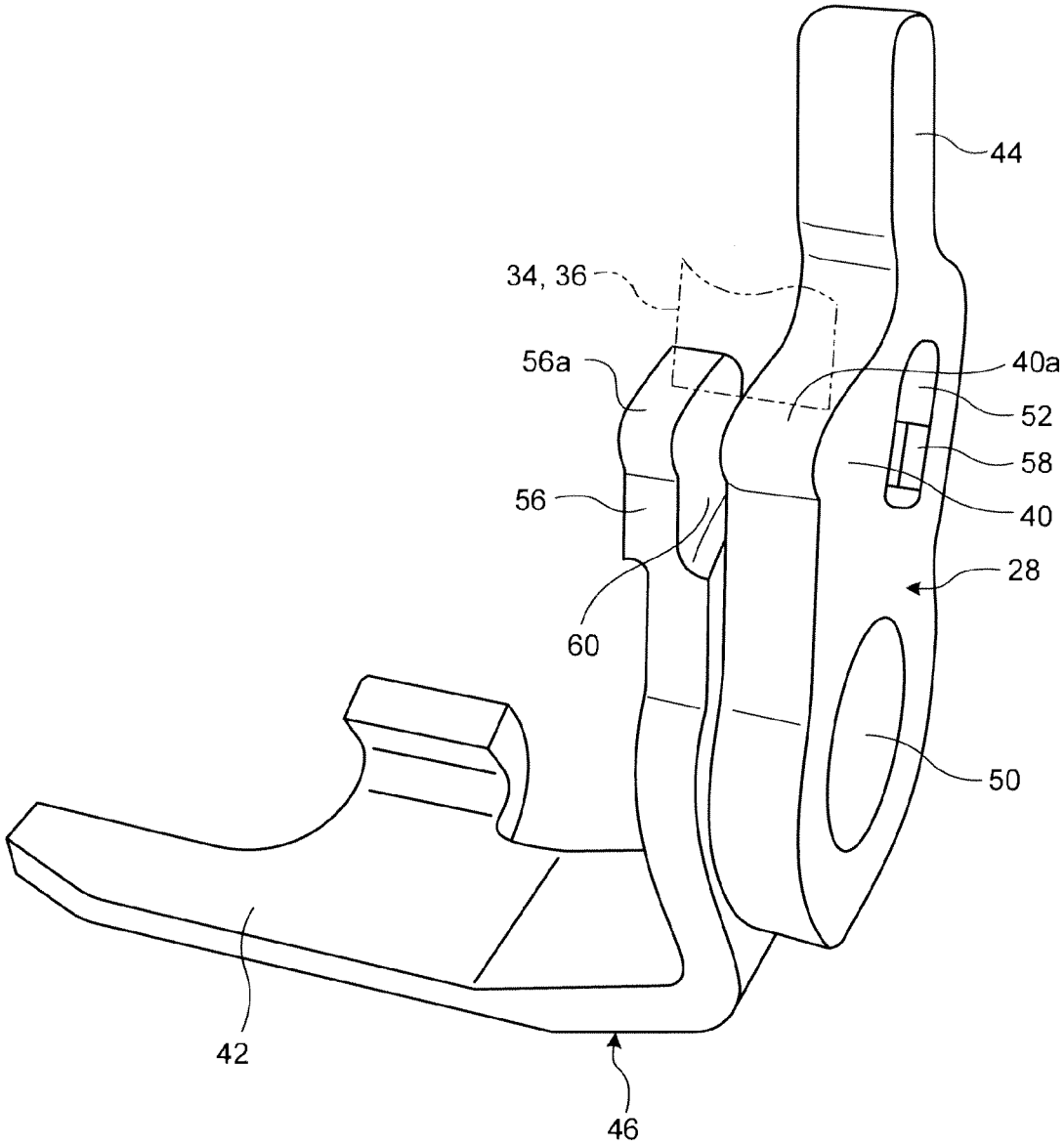
FIG. 8 is a perspective view of the latchet when seen from the main body side in a condition that a resin cover is omitted.
Figure 9:
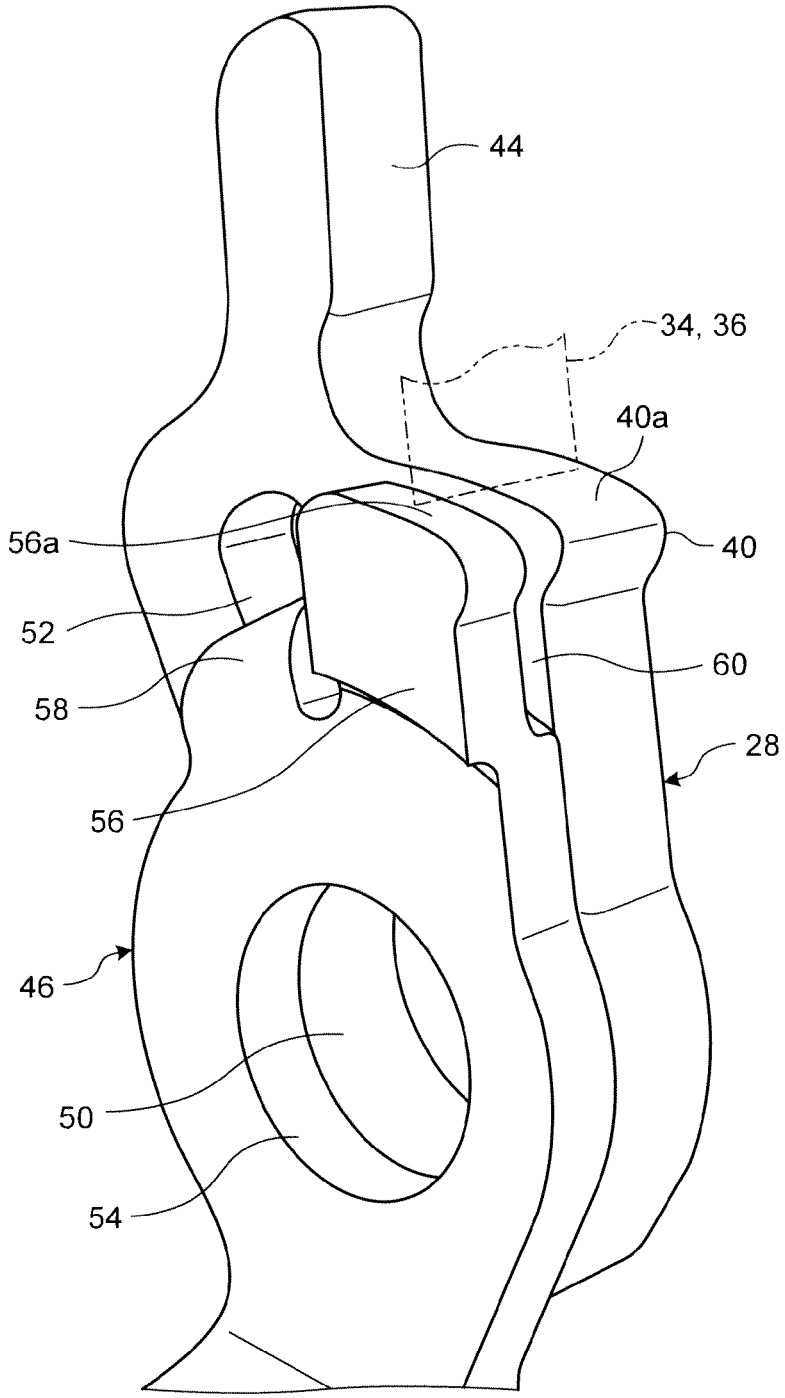
FIG. 9 is a perspective view of the latchet when seen from the cover plate side in the condition that the resin cover is omitted.
Figure 10:
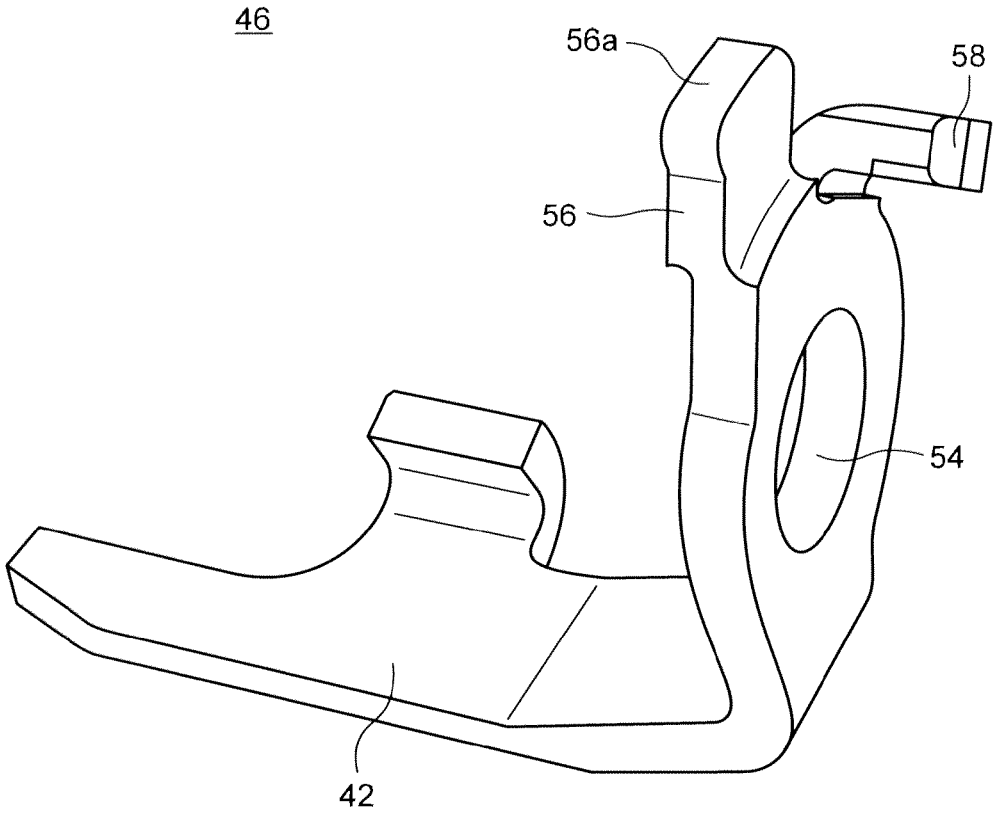
FIG. 10 is a perspective view of a latchet lever.
Figure 11:
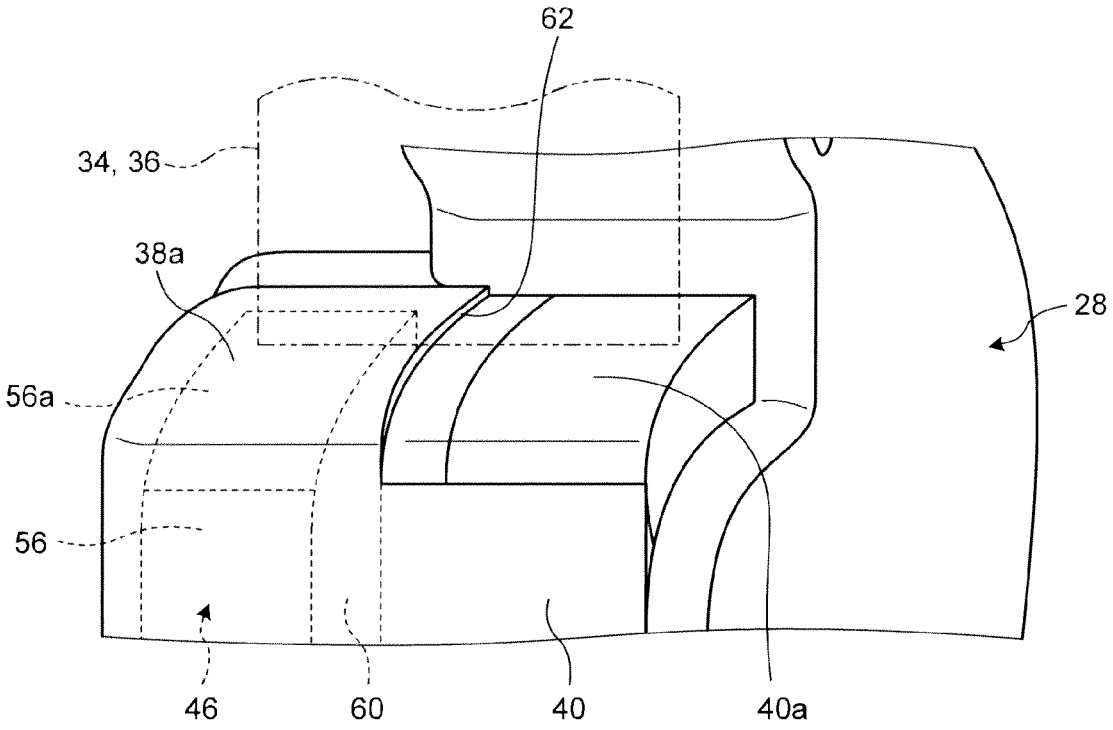
FIG. 11 is a principal part-enlarged perspective view of the latchet.
Figure 12A:
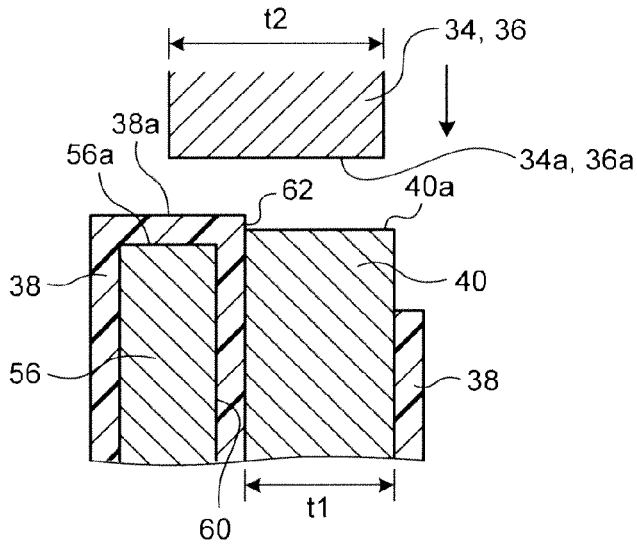
FIGS. 12A to 12C are principal part-enlarged cross-sectional views of the latch and the latchet along a plate-thickness direction of the latchet.
Figure 12B:
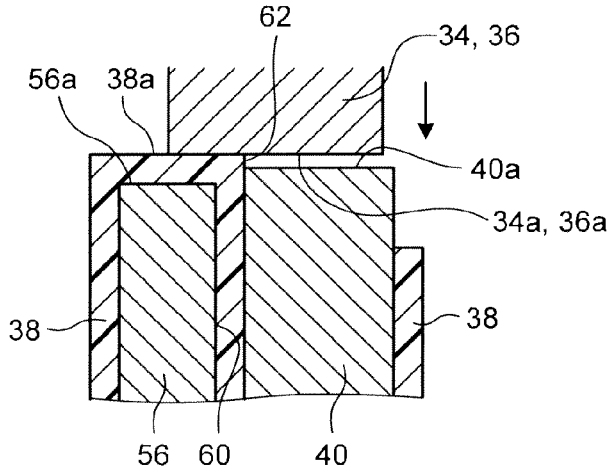
Figure 12C:
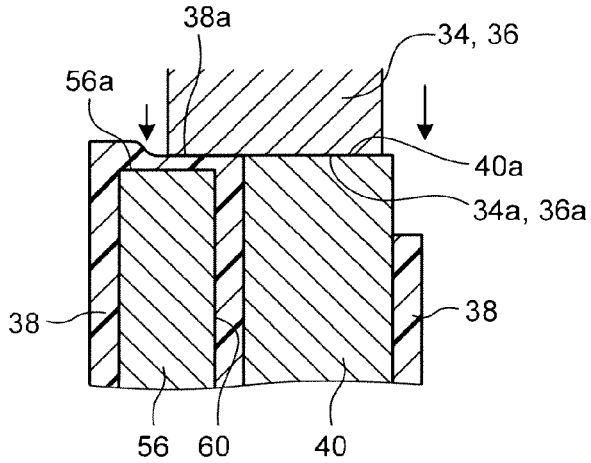

FIG. 6 is a perspective view of the latchet 28 when seen from a main body 16 side, and FIG. 7 is a perspective view of the latchet 28 when seen from a cover plate 18 side. FIG. 8 is a perspective view of the latchet 28 when seen from the main body 16 side in a condition that the resin cover 38 is omitted, and FIG. 9 is a perspective view of the latchet 28 when seen from the cover plate 18 side in a condition that the resin cover 38 is omitted. FIG. 10 is a perspective view of the latchet lever 46. FIG. 11 is a principal part-enlarged perspective view of the latchet 28. FIGS. 12A to 12C are principal part-enlarged cross-sectional views along a plate-thickness direction of the latchet 28; and FIG. 12A is a cross-sectional view in a condition that the latch 26 does not mesh with the latchet 28; FIG. 12B is a cross-sectional view in a condition when the latch 26 begins to abut on the latchet 28; and FIG. 12C is a cross-sectional view in a condition that the latch 26 fully meshes with the latchet 28.

The latchet 28 is an approximately rectangular plate-shaped member in which a through hole 50 in the plate-thickness direction, to which the latchet axis 24 is inserted, and a fit hole 52 above the through hole 50 are formed, as illustrated in FIGS. 8 and 9 by omitting the resin cover 38. The protrusion piece 44 is provided at an upper part of the latchet 28 in a protruding manner, and an end face (upper surface) slightly inclining toward the latchet 28 side from a root portion of the protrusion piece 44 forms the meshing surface 40*a* of the meshing portion 40.

The latchet lever (lever latchet) 46 is an approximately L-shaped and plate-shaped member integrally fixed so as to overlap with a side part of the latchet 28 as illustrated in FIGS. 8 to 10. The latchet lever 46 includes: in a portion along the latchet 28 (that is, a portion parallel with the latchet 28), a through hole 54 in the plate-thickness direction, in which the latchet axis 24 is inserted; a supporting member (supporting unit) 56 that is an arc-like end face forming an upper edge portion and protrudes upward from a latch 26 side; an attachment piece 58 that bends in the direction perpendicular to the latchet 28 and protrudes from a back surface side of the supporting member 56; and the release lever unit 42 is provided at a portion that is formed by bending a lower end of a portion along the latchet 28 at approximately 90°. The attachment piece 58 is inserted into and fitted with the fit hole 52 of the latchet 28 and the latchet axis 24 is inserted into the through hole 54 and the through hole 50 of the latchet 28, so that the latchet lever 46 is integrally and rotatably provided to a side part of the latchet 28.

The supporting member 56 is bent in some degree in a direction away from a side face of the latchet 28, and then extends upward so as to be parallel with the side face of the latchet 28, so that a valley-shaped gap 60 is formed between a side face of the supporting member 56 and the side face of the latchet 28; and an end face (upper surface) of the supporting member 56 forms a supporting surface (end face) 56*a* that lines with the meshing surface 40*a* of the latchet 28 at a lower position than the meshing surface 40*a* (also, see FIG. 12).

As illustrated in FIGS. 6, 7, 11, and 12, the resin cover 38 is molded to cover a most part of the latchet 28 and the latchet lever 46 altogether, which are integrally provided as described above; and at least the meshing surface 40*a* and its periphery portion of the latchet 28, and the release lever unit 42 are metal exposed portions (metal exposed surfaces) that are not covered with the resin cover 38. Here, as illustrated in FIGS. 11 and 12, the resin cover 38 is molded so as to surround all of the periphery of the supporting member 56, so that an exterior surface (buffer) 38*a* of the resin cover 38 is formed so as to cover the supporting surface 56*a* of the supporting member 56; and further, the gap 60 is filled up with the resin material that forms the resin cover 38.

At this time, as illustrated in FIG. 12, the exterior surface 38*a* of the resin cover 38 is molded above the supporting surface 56*a* of the supporting member 56, which is positioned at a lower position than the meshing surface 40*a* of the latchet 28, so that the exterior surface 38*a* is set to be a higher position than the meshing surface 40*a* in some degree, and a step portion 62 is formed between the exterior surface 38*a* and the meshing surface 40*a*. Also, as illustrated in FIG. 12A, the width (plate thickness) t1 of the meshing surface 40*a* of the latchet 28 is set narrower than the width (plate thickness) t2 of the first meshing surface 34*a* and the second meshing surface 36*a* formed in the half-latch meshing portion 34 and the full-latch meshing portion 36 of the latch 26. In the case of the present embodiment, the width t2 of the first meshing surface 34*a* and the second meshing surface 36*a* of the latch 26 is set to be the width from in the vicinity of one side edge portion in the plate-thickness direction of the meshing surface 40*a* of the latchet 28 to an approximately center part of the supporting surface 56*a* of the supporting member 56 across the gap 60.

Therefore, in the meshing mechanism LM, in a case where the first meshing surface 34*a* or the second meshing surface 36*a* of the latch 26 meshes with the meshing surface 40*a* of the latchet 28 (see FIGS. 3 and 4), when the first meshing surface 34*a* and the meshing surface 40*a* approach as illustrated in FIG. 12A; first, the first meshing surface 34*a* abuts on the exterior surface 38*a* of the resin cover 38 provided above the supporting surface 56*a* as illustrated in FIG. 12B (see FIG. 12B). Further, as the meshing operation progresses, the first meshing surface 34*a* squashes the exterior surface 38*a*, and the first meshing surface 34*a* abuts on the meshing surface 40*a* to become in a firm meshing condition between metals, whereby the latch 26 and the latchet 28 becomes in a meshing condition.

That is, the first meshing surface 34*a* (the second meshing surface 36*a*) of the latch 26 first abuts on exterior surface 38*a* of the resin cover 38, which is the resin material, and then squashes the exterior surface 38*a* and abuts on and meshes with the meshing surface 40*a* of the latchet 28. Therefore, the resin cover 38 (exterior surface 38*a*) serves as a buffer at the time of abutting between the latch 26 and the latchet 28, and the impact at the time of meshing between the latch 26 and the latchet is absorbed, whereby the abutting sound is reduced.

As described above, according to the latch device for the vehicle 10 of the present embodiment, the meshing surface 40*a* of the latchet 28 is formed narrower than the first meshing surface 34*a* and the second meshing surface 36*a* of the latch 26. The supporting member 56 is arranged with the gap 60 provided between the side face of the supporting member 56 and the side face of the latchet 28 at a side of the latchet 28, and the supporting surface 56*a* that is an end face of the supporting member 56 is provided at a lower position than the meshing surface 40*a*. Further, all of the periphery of the supporting member 56 including the supporting surface 56*a* is covered with the resin material of the resin cover 38, and the gap 60 is filled up with the resin material of the resin cover 38. Furthermore, the exterior surface 38*a* of the resin material that covers the supporting surface 56*a* is provided at a higher position than the meshing surface 40*a*. Accordingly, the exterior surface 38*a* is formed as a buffer capable of abutting on the first meshing surface 34*a* and the second meshing surface 36*a* of the latchet 28.

Therefore, when the latch 26 meshes with the latchet 28, the exterior surface 38*a* of the resin cover 38 as the buffer firstly abuts on the first meshing surface 34*a* (the second meshing surface 36*a*) of the latch 26; thus the abutting sound at the time of meshing can be reduced. In this case, the periphery of the supporting member 56 provided at a side of the latchet 28 is covered with the resin cover 38 and the gap 60 is filled up with the resin material of the resin cover 38. Therefore, the resin cover 38 is firmly fixed to the latchet 28, and the turning up and peeling off of the resin material can be prevented even if the meshing operation between the latch 26 and the latchet 28 is repeated, whereby the abutting sound can be reduced for a long period of time. Furthermore, the supporting surface 56*a* of the supporting member 56, which is one step lower than the meshing surface 40*a* of the latchet 28 is, is provided inside the exterior surface 38*a* of the resin cover 38 serving as the buffer. Therefore, excessive bending of the resin material (the exterior surface 38*a*) by the latch 26 can be prevented and the peeling off of the resin cover 38 can be further securely prevented.

In the latch device for the vehicle 10, the supporting member 56 is configured as a part of the latchet lever 46; therefore it is not necessary to fix a separate member for the supporting member 56 to the latchet 28, thus a simple structure can be realized. Note that the supporting member 56 may be configured as a part of the latchet 28, and in this case, it can be configured in a similar manner to the supporting member 56 by increasing the plate thickness of the meshing surface 40*a*, and machining the increased portion of the plate thickness under the condition that the width t1 (see FIG. 12A) of the meshing surface 40*a* of the latchet 28 is secured, for example.

In the latch device for the vehicle 10, the latchet 28 and the latchet lover 46 are integrally covered with the resin cover 38 at least under the condition that the meshing surface 40*a* of the latchet 28 is exposed. Therefore, the resin cover 38 allows the resin material to turn around a gap and the like formed between the latchet 28 and the latchet lever 46 in addition to a high holding effect by the supporting member 56 and the gap 60. Therefore, the resin cover 38 can be further firmly fixed, and the turning up and peeling off can be further prevented from occurring. In the present embodiment, a case of covering the most part of the latchet 28 and the latchet lever 46 as the resin cover 38 has been exemplarily illustrated. However, any resin cover 38 can be employed as long as at least it can cover the periphery of the supporting member 56 and can exhibit the function as a buffer.

Note that it is clear that the present invention is not limited to the above-described embodiment and can be freely modified without departing from the scope of the present invention.

For example, in the above-described embodiment, a configuration has been exemplarily illustrated in which the supporting member 56 is provided at the meshing surface 40*a* side of the latchet 28 from between the meshing latch 26 and the latchet 28 that meshes with each other, and the exterior surface 38*a* of the resin cover 38 is formed as the buffer at the time of meshing. However, the supporting member may be of course provided at the latch 26 side in an approximately similar manner. However, in this case, it is necessary to provide both of the half-latch meshing portion 34 and the full-latch meshing portion 36 of the latch 26 with a supporting member. Therefore, the structure becomes slightly complicated compared with the configuration example of the above-described embodiment. Note that the shape or the configuration thereof can be properly changed as long as the latch 26 and the latchet 28 can be mutually in a meshing condition and the meshing condition can be released.

In the above-described embodiment, a configuration has been described in which the supporting member 56 is provided only at one side of the latchet 28 (or the latch 26). However, may be configured such that the supporting member 56 is provided at both sides of the latchet 28 (or the latch 26), and the resin cover 38 is molded therein. In this case, the width of the first meshing surface 34*a* and the second meshing surface 36*a* of the latch 26 may be configured to be capable of abutting on the exterior surface 38*a* of the resin cover 38 of the both sides.

According to the present invention, when a latch meshes with a latchet, a buffer formed of a resin material is provided at a side of one of meshing surfaces, and this buffer firstly abuts with the other meshing surface of the latch or the latchet. Therefore, an abutting sound at the time of meshing can be reduced. Furthermore, a periphery of a supporting member provided at a side of the latch or the latchet having the one meshing surface is covered with the resin material and a gap is filled up with the resin material. Therefore, the resin material is further firmly fixed/held and turning up or peeling off of the resin material can be prevented even if a meshing operation between the latch and the latchet is repeated, whereby an abutting sound can be reduced for a long period of time.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A latch device for a vehicle, comprising:

a latch configured to hold and engage with a striker, the latch having a plate shape and a meshing surface on a side surface; and a latchet configured to maintain an engagement condition between the striker and the latch by meshing with the latch, the latchet having a plate shape and a meshing surface on a side surface, wherein, between the meshing surface of the latch and the meshing surface of the latchet meshed with each other, a width in a plate-thickness direction of one of the meshing surface of the latch and the meshing surface of the latchet is formed so as to be narrower than a width in a plate-thickness direction of another of the meshing surface of the latch and the meshing surface of the latchet, wherein a supporting member has a plate shape and is arranged with a gap provided between a plate surface of the latch or the latchet having the one of the meshing surfaces and a plate surface of the supporting member, such that a part of a side surface of the supporting member aligns with the one of the meshing surfaces, and the part of the side surface of the supporting member is provided at a lower position than the one of the meshing surfaces, and wherein a periphery of the supporting member, including the part of the side surface of the supporting member, is covered with a resin material and the gap is filled with the resin material, and wherein an exterior surface of the resin material covering the part of the side surface of the supporting member is provided at a higher position than the one of the meshing surfaces such that the exterior surface is formed as a buffer configured to abut on the another of the meshing surfaces.

2. The latch device for a vehicle according to claim 1, wherein the one of the meshing surfaces is the meshing surface of the latchet, and wherein the supporting member is provided at a latchet lever configured to rotate the latchet by being integrally fixed to a side of the latchet.

3. The latch device for a vehicle according to claim 2, wherein at least some exterior surfaces of the latchet and the latchet lever are integrally covered with the resin material, without the meshing surface of the latchet being covered by the resin material.

4. The latch device for a vehicle according to claim 1, wherein the gap is valley-shaped.

5. The latch device for a vehicle according to claim 1, wherein the one of the meshing surfaces is configured to squash the another of the meshing surfaces, and wherein the buffer is configured to reduce abutting sound from abutment of the latch and the latchet.

6. The latch device for a vehicle according to claim 1, wherein a portion of the supporting member is bent away from the side surface of the latchet and another portion of the supporting member is configured to extend upward so as to be parallel with the side surface of the latchet.

* * * * *